US006390703B1

(12) United States Patent
Kinas et al.

(10) Patent No.: US 6,390,703 B1
(45) Date of Patent: May 21, 2002

(54) MEDIA HANDLING SYSTEM

(75) Inventors: Erick Kinas, Camas; David M. Wetchler; Iranpour Khormaei, both of Vancouver, all of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/661,840

(22) Filed: Sep. 14, 2000

(51) Int. Cl.[7] ..... B41J 29/18; B41J 11/42; B41J 2/315; B41J 2/05

(52) U.S. Cl. ..... 400/708; 400/120.01; 400/579; 347/64

(58) Field of Search ..... 400/708, 120.01, 400/579; 347/64

(56) References Cited

U.S. PATENT DOCUMENTS

| | | | | | |
|---|---|---|---|---|---|
| 5,466,079 | A | * | 11/1995 | Quintana | 400/579 |
| 5,618,120 | A | * | 4/1997 | Ishikawa | 400/708 |
| 5,940,106 | A | * | 8/1999 | Walker | 347/104 |
| 5,957,600 | A | * | 9/1999 | Ju | 400/708 |
| 6,050,674 | A | * | 4/2000 | Hirabayashi et al. | 347/40 |
| 6,190,066 | B1 | * | 1/2001 | Ishigouoka et al. | 400/120.1 |
| 6,213,659 | B1 | * | 4/2001 | Elgee | 400/633 |

* cited by examiner

*Primary Examiner*—Andrew H. Hirshfeld
*Assistant Examiner*—Marvin P. Crenshaw

(57) ABSTRACT

A system is provided for use in a printer, the system including a media width sensor which is configured to sense the presence of media at a predetermined transverse position within the media path. By sensing media at such predetermined transverse position, it is possible to determine media width, and thus to identify media type. Correspondingly, it is possible to adapt media handling to address particular characteristics of the media, namely, thickness of the media and width of the media sheets.

23 Claims, 5 Drawing Sheets

MEDIA HANDLING SYSTEM

TECHNICAL FIELD

The present invention relates generally to media handling in printers. More particularly, the invention relates to a system for use in determining media type and selectively supporting printed media during printing so as to optimize printhead-to-media spacing and to reduce media skew in printers.

Although the invention has broad utility, it has proven particularly well-suited for use in inkjet printers which employ pivotal wings to support media above an output tray while ink on a preceding media sheet is allowed time to dry. Such printers, it will be appreciated, also may employ mechanisms which aid in support of an expelled media sheet by establishing a sheet-stiffening bow in the expelled media sheet. The present invention is described in the context of such an inkjet printer below.

BACKGROUND ART

In a conventional ink-jet printer, media is directed through a print cycle which includes picking up a media sheet from an input tray, feeding it through the printer's print zone, and expelling it through an output port. Typically, expelled media is supported momentarily, before falling to an output tray where consecutive sheets pile, one on top of the other, to form an output stack. This momentary delay is useful inasmuch as it provides the previously printed sheet with time to dry before placing the present sheet on the output stack. Because inkjet printers print using wet ink, the aforementioned methodology is particularly useful in inkjet printers.

Printer manufacturers have employed a variety of mechanisms to accomplish this momentary delay in stacking printed media sheets. One such mechanism embodies a passive drop scheme, wherein a media sheet emerging from the printer's output port is guided along rails which suspend the sheet above the output tray. At the completion of printing, the sheet simply drops of its own weight into the output tray, the previously printed sheet having had an opportunity to dry during printing of the present sheet. It will be appreciated, however, that passive drop schemes are not always reliable due to variations in media characteristics (e.g., media thickness), and/or due to a phenomenon known as cockling. As a result, sheets do not always drop into the output tray after printing. Instead, printed sheets may be pushed forward and out of the printer by the following printed sheet. This cockling effect may become more pronounced with environmental extremes and/or with large amounts of ink on a sheet.

Another solution involves the use of an active drop mechanism wherein a printed sheet is guided along a pair of movable wings which temporarily support the printed sheet above the output tray. Once printing is complete, the wings retract, often pivotally, allowing the sheet to fall into the output tray below. One such system is described in U.S. Pat. No. 5,324,020 to Rasmussen et al., the subject matter of which is incorporated herein by this reference. Although generally effective, active wing arrangements may not be suitable for a wide range of media widths, and may present some problems due to sheet sail, a phenomenon which can result in sheets sailing out of the printer upon retraction of the wings.

In order to address these issues, the printer may be provided with a system whereby a printed sheet is temporarily supported above the output stack in a sheet-stiffening bow. This may be accomplished using a guide mechanism with an elongate channel which receives a predetermined side edge of an expelled sheet. One such system is described in U.S. Pat. No. 5,603,493 to Kelly, the subject matter of which is incorporated herein by this reference. Similarly, the printer may employ pivotal wings as described above, but with an opposing pinch member configured to impart the aforementioned sheet-stiffening bow to the printed sheet.

Although such systems work well for most types of sheet media, difficulties still may arise where thicker media, or where narrower media (e.g., envelopes, card stock, etc.) are employed. It will be appreciated, for example, that thicker media will tend to bow more significantly when pinched as described above, thus bringing the media closer to the printer's printhead. In fact, it is possible that the media will actually touch the printhead, causing ink to smear on the media, and potentially damaging the printhead. Correspondingly, narrow media may experience skew due to contact with the wing and/or guide mechanism, particularly where the media is urged into the aforementioned sheet-stiffening bow. In the past, variances in the degree of media bow have been addressed by increasing printhead-to-media spacing, potentially at the expense of print quality and printer size. This, however, has failed to address problems related to media skew.

What is needed is a media handling solution which provides printed sheets with adequate drying time, which addresses problems related to differences in media type (e.g., ink smear) and media skew.

DISCLOSURE OF THE INVENTION

A system is provided for use in a printer, the system including a media width sensor which is configured to sense the presence of media at a predetermined transverse position within the media path. By sensing media at such predetermined transverse position, it is possible to determine media width, and thus to identify media type. Correspondingly, it is possible to adapt media handling to address particular characteristics of the media, namely, thickness of the media and width of the media sheets.

In particular, the invented system employs a media support positioned along the media path downstream from the width sensor and configured to support printed media of a first type upon identification of the media by the media width sensor as being of the first type, and configured to refrain from support of printed media of a second type upon identification of the media by the media width sensor as being of the second type. Typically, it is desirable to support thinner media (such as single-layer A-size paper), but to refrain from supporting thicker media (such as envelopes, card stock or the like). Similarly, it is desirable to support wider types of media (such as A-size paper), but to refrain from supporting narrower media (such as envelopes, card stock or the like).

In one embodiment, the media width sensor takes the form of an optical sensor positioned in a predetermined transverse position along the media path such that media which exceeds a corresponding width is sensed by the sensor so as to identify the media as being of the first type. The sensor may be fixed in such predetermined transverse position, or selectively moved to such position via a reciprocating carriage or the like. It also will be appreciated, that the sensor may take the form of a mechanical sensor or any other sensor capable of detecting presence of media at a predetermined transverse position within the media path.

Alternatively, the media width sensor may take the form of an optical sensor configured to scan the media path. Upon detecting a threshold change in luminance, an edge of the media may be identified, making it possible to determine media width based on a known position of the sensor relative to an edge of the media path. Upon determining the media width, such width may be compared to a table of known media widths in order to determine media type, thus determining media thickness, and whether to support printed media as it exits the output port.

The media support typically takes the form of a pair of pivotal wings configured to selectively urge printed media into engagement with opposing pinch members, thus creating the desired sheet-stiffening bow in the printed sheet. This sheet-stiffening bow is desirable for thin media (e.g. A-size paper) in order to momentarily support the printed media above the output stack and to prevent sheet sail. However, thicker media (e.g. envelopes) tends to bow undesirably when supported by the aforementioned pivotal wings, potentially resulting in contact with the printer's printhead. This, in turn, may result in smearing of ink on the media, or even damage to the printhead. Furthermore, narrower media (which typically is supported on only one side of the media sheet) may experience media skew, typically due to differing frictional effects on opposite sides of the printed sheet.

Accordingly, the invented system provides a media handling method which includes: 1) identifying a type of media passing through the media path; 2) printing on the media; and 3) where the identified media is of a first type, supporting the media upon printing on the media, and where the media is of a second media type, refraining from support of the media upon printing on the media. As indicated above, the media may be identified either via a sensor in a predetermined transverse position to identify media within a predetermined width range (e.g. >5-inches), or via an optical sensor which scans the media to determine actual media width. In either event, the determined media width may be matched to a corresponding media type.

In one embodiment, media is considered to be of the first type if it is a thin (e.g. single layer) media such as A-size paper, and is considered to be of the second type if it is thick (e.g. multi-layer) media such as envelopes or the like. Similarly, narrow media (e.g. cards, letter envelopes, etc) may be considered to be of the second type (regardless of media thickness) in order to address problems of media skew.

Furthermore, it may be assumed that the initial media sheet of a print job is of the second type, the printer being directed to retract the wings prior to printing the initial media sheet of the print job. This addresses problems of printhead-to-media spacing and media skew where there is insufficient time to identify media type prior to beginning printing. The initial media sheet of the present print job may be printed at a predetermined elapsed time after completing the preceding print job, thus allowing adequate time for the last sheet of the preceding print job to dry. The actual media type of the initial sheet is determined during printing as the initial sheet passes through the media path.

Upon determining the actual media type of the initial sheet of a present print job, it may be assumed that all subsequent media sheets of the present print job are of the same media type. Subsequent media sheets of the present print job thus may be treated in accordance with the aforementioned methodology. Where the identified media is of a first media type, the wings are extended such that the media is supported upon printing on the media. Where the media is of a second media type, the wings are retracted so as to refrain from support of the media upon printing on the media.

DETAILED DESCRIPTION AND BEST MODE FOR CARRYING OUT THE INVENTION

Figure 1:
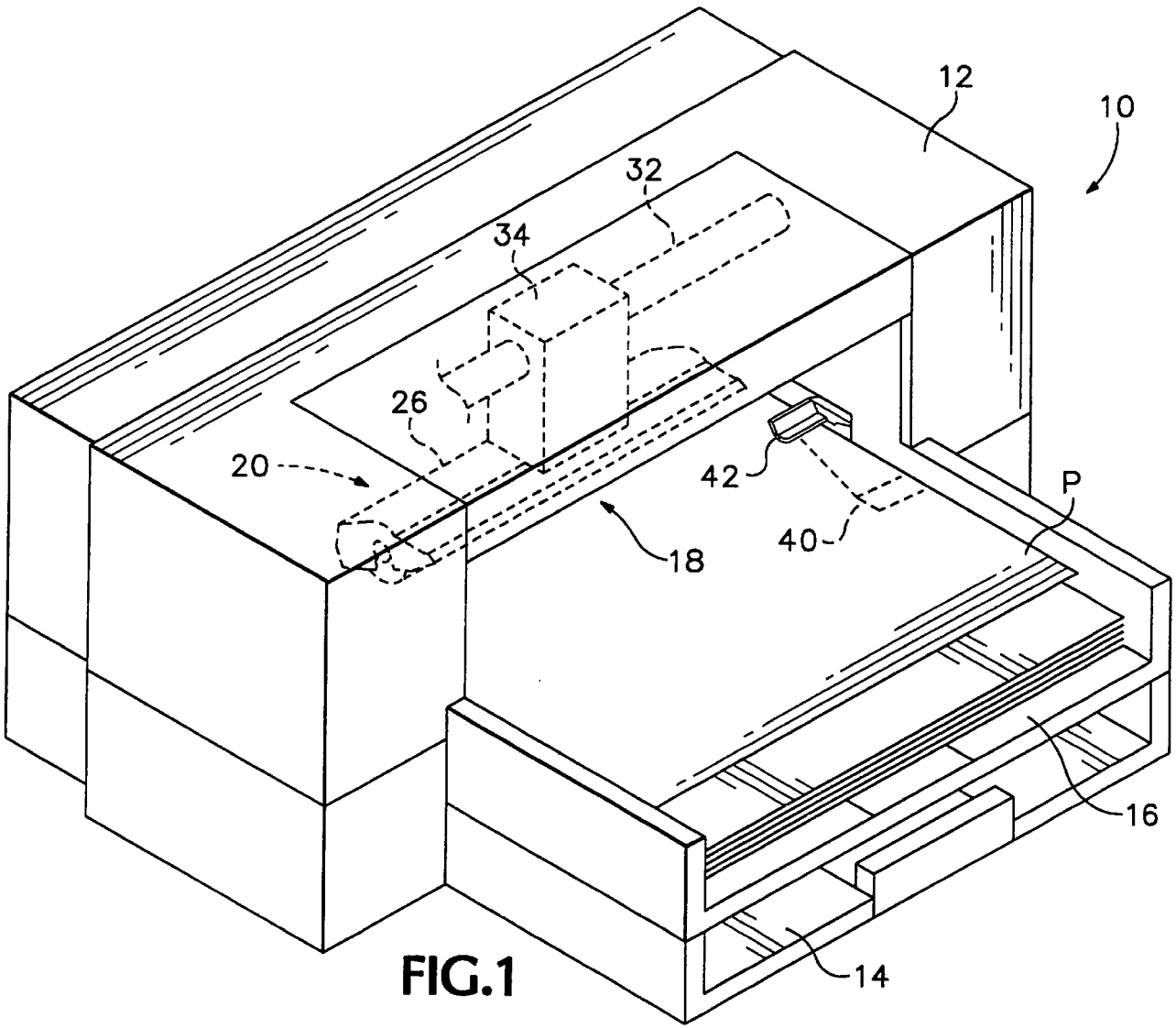
FIG. 1 is an isometric view of a single-sheet inkjet printer incorporating a media handling system constructed in accordance with the present invention.

Referring initially to FIG. 1, there is shown a typical single-sheet ink-jet printer 10, such printer including chassis 12 which includes an input tray 14, and an output tray 16. The input tray holds media prior to input. The output tray holds media once it has been printed on and expelled through the printer's output port 18.

A media advancement mechanism 20 directs the media through the printer, sheets being pulled consecutively from the input tray and passed downstream along a media path to the printer's print zone. Once a media sheet enters the print zone, a reciprocating printhead 34 selectively deposits ink on the sheet, and the sheet is passed further downstream along the media path. Printed sheets are expelled through output port 18, momentarily supported while ink on the preceding printed sheet dries, and then released for stacking in the output tray below. As shown, the output tray typically is positioned adjacent the printer's chassis, the tray's floor generally lying some distance below the output port to accommodate support of a multi-sheet output stack.

Figure 2:
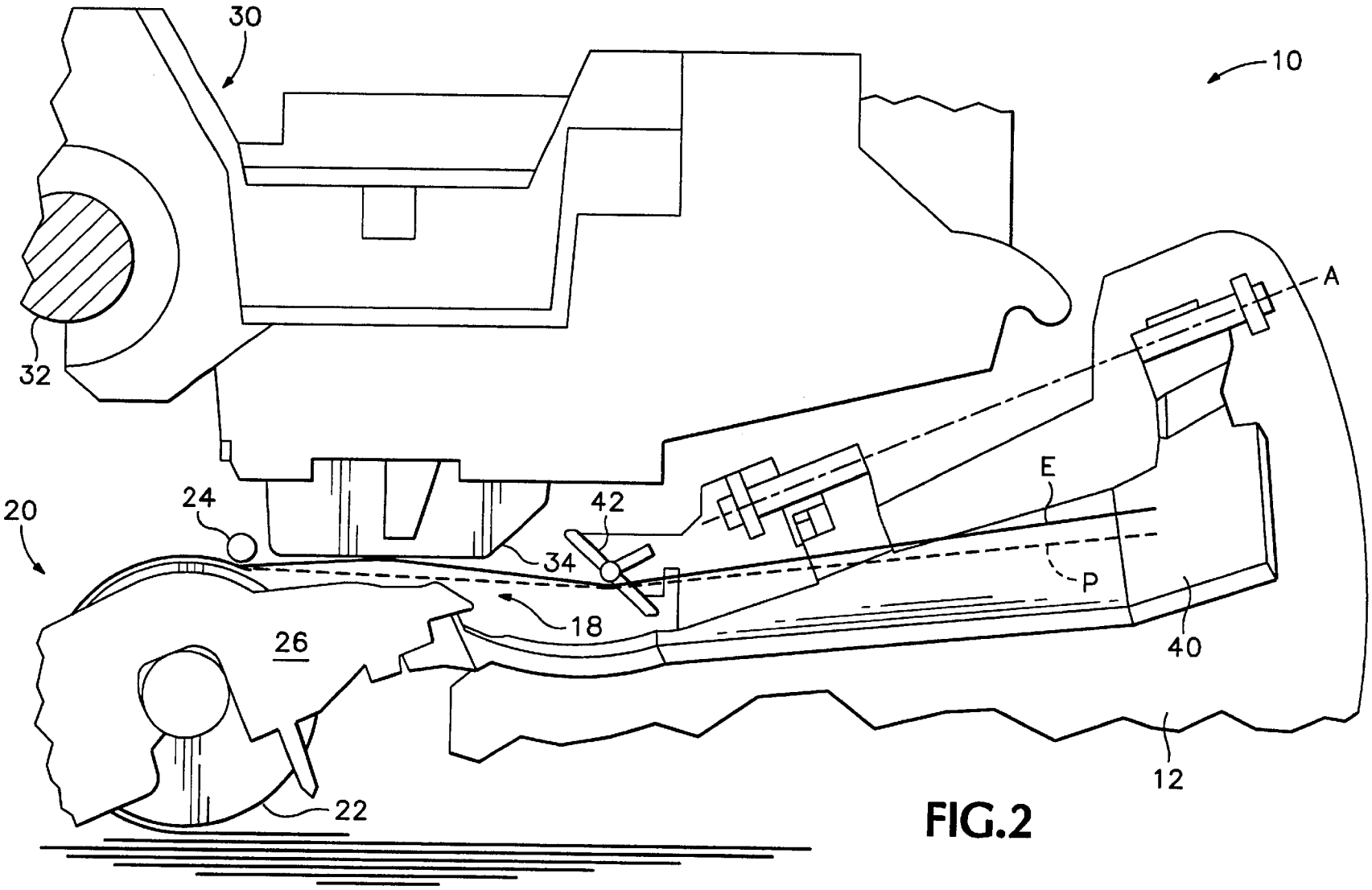
FIG. 2 is an enlarged, fragmentary, side sectional view of the printer depicted in FIG. 1, such view illustrating expulsion of an envelope with the envelope supported by a retractable wing.
Figure 3:
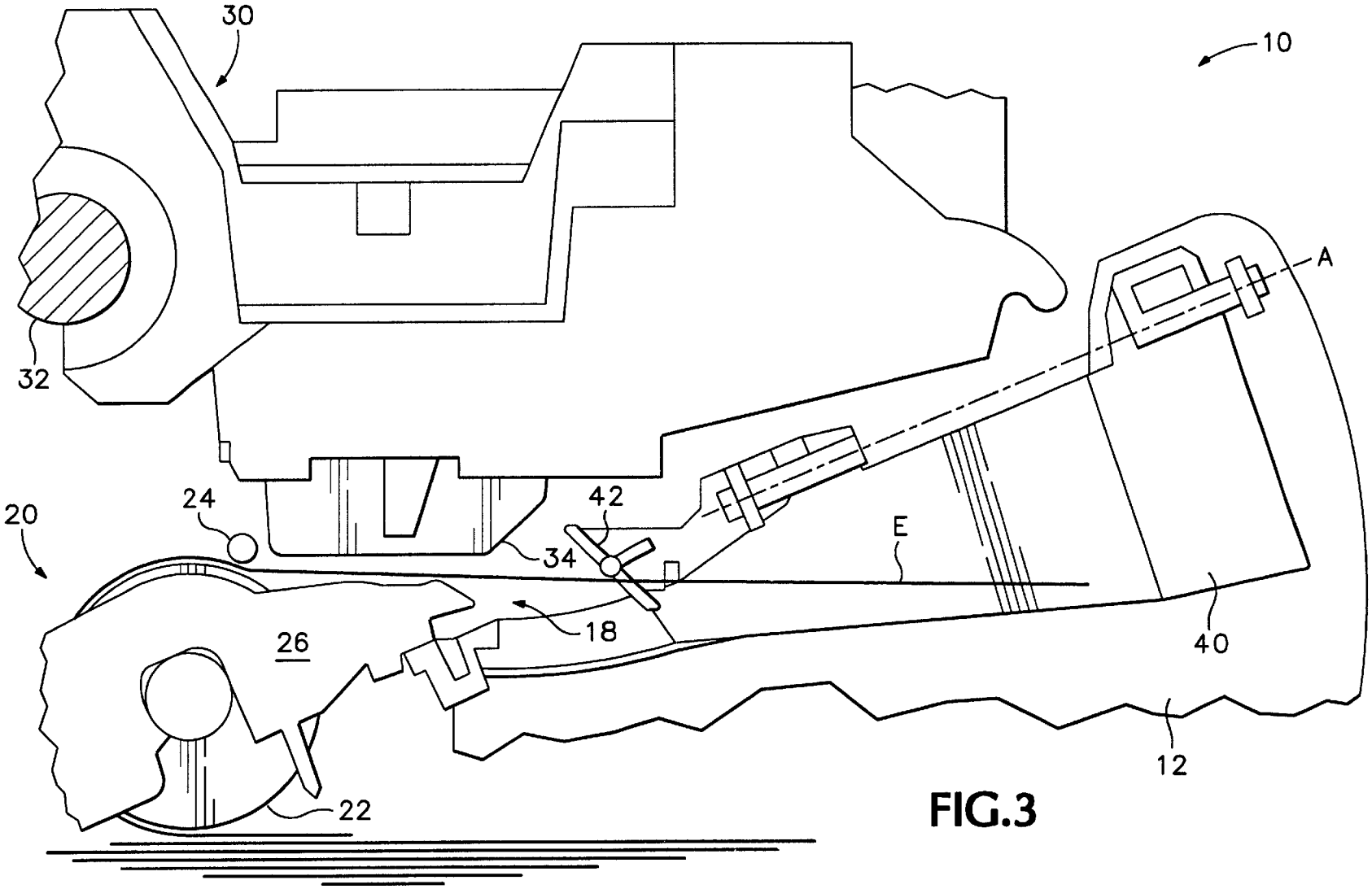
FIG. 3 is an enlarged, fragmentary, side sectional view similar to FIG. 2, but with the wing retracted.

Referring now to FIGS. 1 through 3, it will be noted that media advancement mechanism 20 includes a plurality of drive rollers 22 which pass sheet media along the media path. The rollers pick consecutive sheets from the input tray, each sheet being guided around the drive rollers, and passed between the drive rollers and a corresponding opposing roller 24. Thereafter, media is passed over stationary platen 26 (through the printer's print zone) and expelled through the printer's output port 18.

A printhead carriage 30 is mounted above the platen, typically on a guide 32 which accommodates reciprocal motion of the carriage during a print operation. As should be apparent, the printhead carriage carries an ink cartridge with a printhead 34 configured to selectively deposit ink on media as the media passes through print zone between platen 26 and printhead 34. Although a single ink cartridge is depicted, it is to be understood that the carriage may carry one or more ink cartridges, each including one or more printheads. Carriage 30 also may carry an optical sensor 50 (FIG. 4) for use in determining media width as will be described in detail below.

In the depicted embodiment, printhead 34 remains at a predetermined distance from platen 26, such distance defining a throat through which media passes during a print job. In contrast, it will be appreciated that the printhead-to-media spacing varies with variances in media thickness. However, once the type of media is known, media thickness may be determined. Accordingly, printhead 34 may be adapted to compensate for such variance in printhead-to-media spacing, provided that printhead-to-media spacing is within predefined limits.

In accordance with the present invention, printer 10 is provided with a media handling system including a media support configured to selectively temporarily support a printed media sheet above output tray 16 while ink on a preceding media sheet (on the top of the output stack) is allowed time to dry. Once the ink on the preceding media sheet has dried (as determined by a predetermined elapsed time), the printed media sheet is released, and falls to the top of the output stack within the output tray. Optimally, release of the printed media sheet will correspond closely with the completion of printing on such media sheet so as to avoid delay in printer throughput.

Referring now particularly to FIG. 1, it will be noted that the media handling system employs a media support positioned along the media path, downstream from output port 18, to selectively momentarily support printed media P above output tray 16. In the depicted embodiment, the media support includes a pair of guide members which are selectively retractable under direction of a processor (not shown). As indicated, the guide members typically take the form of pivotal wings 40 mounted to the printer chassis 12 adjacent opposite side edges of the printer's output port 18. During a given print operation, printed media is expelled through output port 18, the media being guided onto wings 40 to support the printed media above output tray 16 while ink on the preceding media sheet dries. Upon expiration of a predetermined elapsed time, the wings are pivotally retracted (each about an axis A as shown in FIGS. 2 and 3), allowing the printed sheet to fall to the output stack below.

Although wings 40 typically are present on both sides of the output port, the invented system similarly may be implemented with the single guide member, typically on the right side (right-justified) as viewed from the top, front of the printer in FIG. 1. It will be understood, however, that left-justified support similarly could be accommodated by mounting a guide member adjacent the left side of the output port.

The depicted handling system also includes a pair of pinch members 42, such pinch members being positioned above pivotal wings 40 as shown. The wings, in turn, are configured to selectively urge printed media into engagement with such opposing pinch members, creating a sheet-stiffening bow in the printed sheet. This configuration allows for shorter wings, and reduces the risk of sheet sail. However, the use of such pinch members may complicate difficulties associated with printhead-to-media spacing for thicker media (where the media may bow to an extent whereby it will engage the printhead, causing smearing of ink on the media, and potentially, damage to the printhead), and may increase the risk of media skew. The present invention addresses both of these concerns.

The present invention arises from the realization that the aforementioned concerns may be addressed by refraining from support of selected types of printed media upon exit from the output port. Accordingly, the wings 40 are configured to support printed media of a first type upon identification of the media as being of the first type, and configured to refrain from support of printed media of a second type upon identification of the media as being of the second type. Typically, it is desirable to support thinner media (such as single-layer A-size paper), but to refrain from supporting thicker media (such as envelopes, card stock or the like). Correspondingly, it is desirable to support wider media (such as A-size paper), but to refrain from supporting narrower media (such as envelopes, card stock or the like).

Focusing attention for a moment on the path of media throughput, it will be s noted that such media path is defined with a transverse width which corresponds to the maximum width of media to be passed therethrough. In the depicted embodiment, the path width corresponds to the width of conventional A-size paper, but those skilled in the art will recognize that the path width need not be so limited. Most commonly, the media path would be defined at least to accommodate passage of letter-sized sheets.

Figure 4:
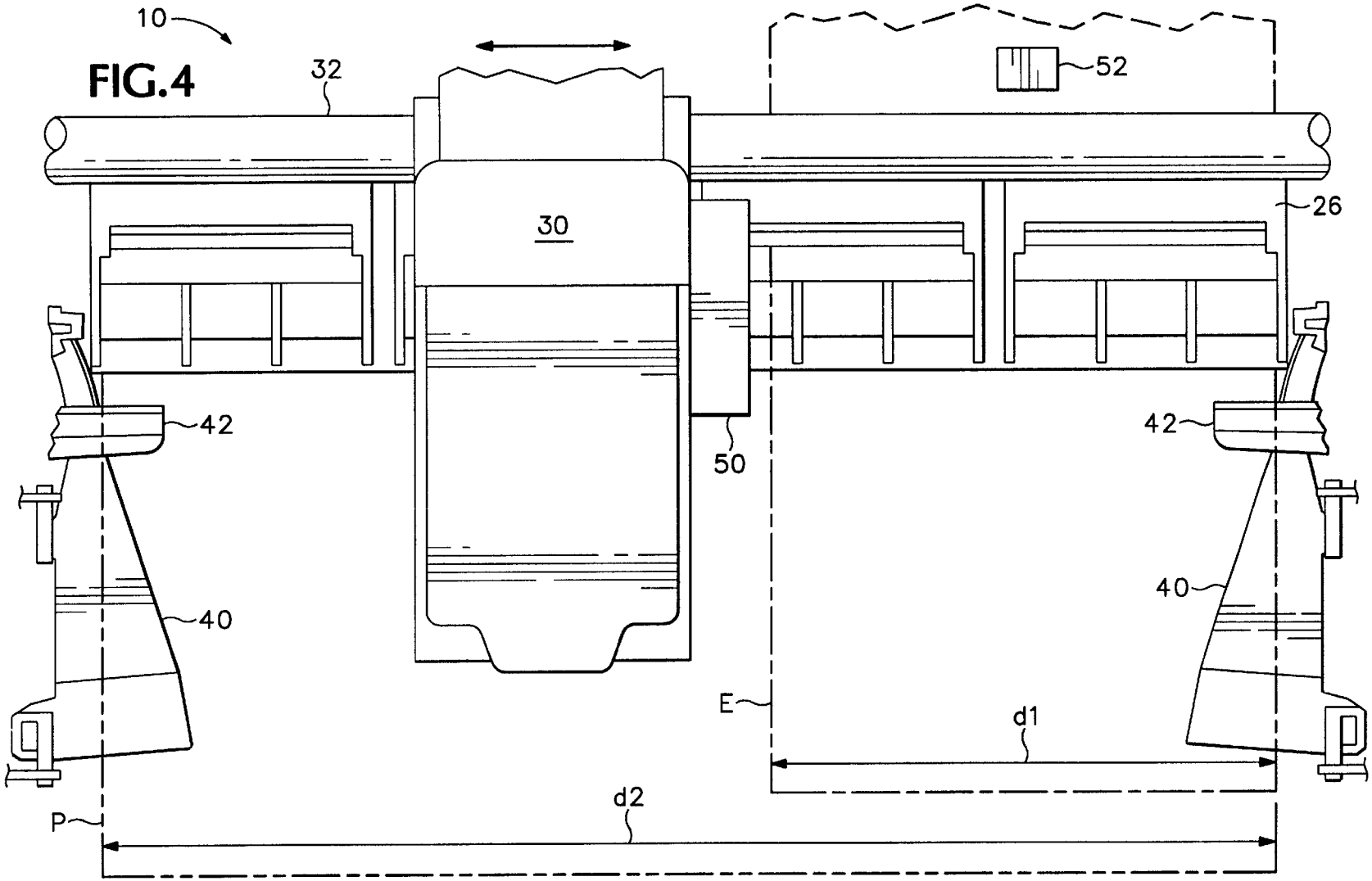
FIG. 4 is a somewhat schematic top plan view of the printer depicted in FIG. 1, such view illustrating support of various media types.

FIG. 4 illustrates the flow of various media types (namely, A-size paper P and envelope E) through the printer, each being shown in phantom as it is expelled from the printer's output port. As indicated, the media is justified to the right edge of the media path, providing a known edge position to accommodate determination of media width as will be described below.

Attention is now drawn to the fact that different types of media exhibit different physical characteristics, the most noteworthy of such characteristics being the media's thickness and width. Because most types of media exhibit different width characteristics, it is often possible to identify a type of media by determining the media's width. Correspondingly, because media type generally is known for a given width of media, it is possible to identify media type (e.g., envelope of A-size paper) simply by determining the media's width. An envelope, for example, generally is narrower than either executive or A-sized paper, but is not as wide as either executive or A-sized paper. Media type is in this sense linked to media width.

Based on the foregoing, it should be apparent that each of the illustrated media types will extend a known distance from the right edge of the media path, such distance corresponding to the media's. width. Envelope E, for example, extends a distance dl from the path's right edge, such distance generally corresponding to a width of approximately 10.5-centimeters across. A-sized paper P extends a distance d2 from the path's right edge, such distance corresponding to a media width which is approximately 21-centimeters across. The media path thus may be considered to consist of two transverse regions, first region which extends a distance d1 from the path's right edge and a second region which extends from the path's first region to the path's left edge.

It will be understood that both envelope E and A-sized paper P pass through the first transverse region of the media path, but that only A-sized paper P passes through the second transverse region of the media path. Accordingly, where the possible media set consists of A-size paper and envelopes, the presence of A-size paper may be detected by a noted presence of media in the second transverse region of the media path during a print operation. Conversely, an envelope may be passively detected by a noted absence of media in the second transverse region of the media path during a print operation. Where media is of a first type (e.g. A-size paper P), the wings are raised to momentarily support the media upon expulsion from the output port. Where the media is of the second type (e.g. envelope E), the wings are not raised, and the media is left to extend in cantilever fashion from the output port (as depicted in FIG. 3) until such time as the media is fully expelled.

It is to be understood that, although the present invention is described in connection with a possible media set which consists of A-size paper and envelopes, the principles embodied herein may similarly be employed for possible media sets which include any number of different media forms. Such media forms, it will be appreciated, typically are characterized by particular media widths, and thus by presence of media in particular transverse regions of the media path.

Referring now again to FIGS. 2 and 3, the effect of retracting wings 40 is illustrated. The illustrated disparate effect is the result of differing characteristics of the two media types. A-size paper P, it will be appreciated, is a relatively wide, single-layer media, typically on the order of approximately 4 mils thick. Envelope E, it will be appreciated, is a relatively narrow multi-layer media, typically on the order of approximately 6–8 mils thick, or more.

In FIG. 2, where the wings are shown in a deployed orientation, A-size paper P (shown in dashed lines) is pinched to create a sheet-stiffening bow, the extent of which does not interfere with printing. However, envelope E (shown in solid lines) is bowed to a greater extent, resulting in contact with the printer's printhead 34, thus smearing ink on the envelope and potentially damaging the printhead.

In FIG. 3, where the wings are shown in a retracted orientation, envelope E (shown in solid lines) extends out of output port 18 in cantilever fashion. The media is not supported by wings 40. Accordingly, the media is not bowed as in FIG. 2, and does not extend into contact with printhead 34. However, due to the stiffness of envelope E, the media remains suspended above the output tray until it is expelled, and thus provides ink on the preceding sheet adequate time to dry.

As indicated above, the media handling system employs a media width sensor 50 (FIG. 4), such sensor typically being mounted on printhead carriage 30 to accommodate selected transverse positioning of the sensor by transverse adjustment of printhead carriage 30. The sensor may take the form of an optical sensor, sensor 50 thus typically is configured to sense presence of media at a predetermined transverse position within the media path so as to determine media width. With this information, it is possible to identify media type, and thus to adapt the printer to handle different types of media differently in order to reduce the risk of ink smear, printhead damage and/or media skew.

As indicated previously, printer 10 includes a reciprocating printhead carriage 30 which travels along guide 32, carriage 30 being configured to carry a printhead 34 which scans print media within the media path so as to deposit ink on the media under direction of a processor (not shown).

Referring to FIG. 4, it will be appreciated that the printer also may include a media detector 52, typically positioned at a different transverse position than sensor 50 along the media path (typically adjacent the right edge of the media path) so as to determine presence of any media within the media path. Media detector 52 similarly may take the form of a mechanical sensor, or an optical sensor, fixed to the printer chassis to detect any presence of media within the media path.

It is to be noted that sensor 50 typically takes the form of an optical sensor which quantifies luminance in its line of sight. Because the printer's platen typically is dark (e.g., black), and media typically is light (e.g., white), there is a marked difference between sensing the platen and sensing media. Accordingly, an optical sensor is capable of readily detecting media upon noting a predetermined threshold luminance.

In accordance with the depicted embodiment, sensor 50 may be positioned at various transverse positions along the media path by movement of printhead carriage 30. Therefore, upon passage of media through the print zone, sensor 50 may be employed to determine whether media is present at any of various predetermined transverse positions within the media path. Alternatively, sensor 50 may be fixed relative to the chassis so as to detect media at a predetermined transverse position within the media path. By determining whether media is present at one or more predetermined transverse positions within the media path, it is possible to identify media type. For example, by placing the printhead carriage in the position shown in FIG. 4, it is possible to identify A-size paper P by sensing passage of media beneath sensor 50. Conversely, it is possible to identify envelope E by sensing presence of media beneath media detector 52, but failing to sense media beneath sensor 50.

Figure 5:
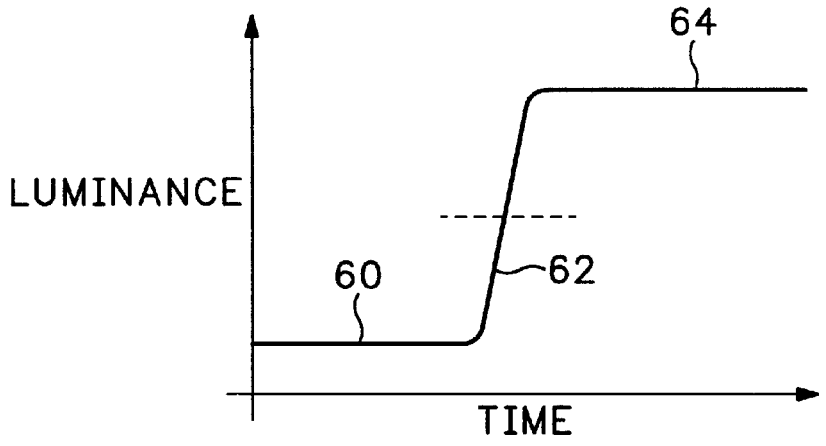
FIG. 5 is a graph plotting luminance over time so as to illustrate scanning of the media path to determine media width.

In another embodiment, printhead carriage 30 may be directed to scan the media path passing sensor 50 across the media path so as to more particularly identify an edge of a media sheet passing through the media path. Luminance as sensed by sensor 50 during such a scan is illustrated in FIG. 5, luminance being plotted over time as the printhead carriage scans the media path at a known velocity (or velocities). As sensor 50 travels transversely across the media path (typically from left to right), the luminance initially is of a low level as indicated at 60 in FIG. 5. However, when the sensor passes over the edge of the media, luminance rises very sharply as indicated at 62, thus identifying the media's left edge. Thereafter, the elevated luminance, as indicated at 64, indicates presence of media below sensor 50.

By noting the position of the printhead carriage (as determined by processor control of the printhead carriage) at the point luminance passes a predetermined threshold, it is possible to determine the distance from the known right edge of the media to the detected left edge. This distance corresponds to the media width. Because different types of media are characterized by different widths, it is possible to identify a particular media type upon determining media width. Therefore, by reference to an appropriate look-up table in memory, it is possible to determine media type and/or media thickness.

Figure 6:
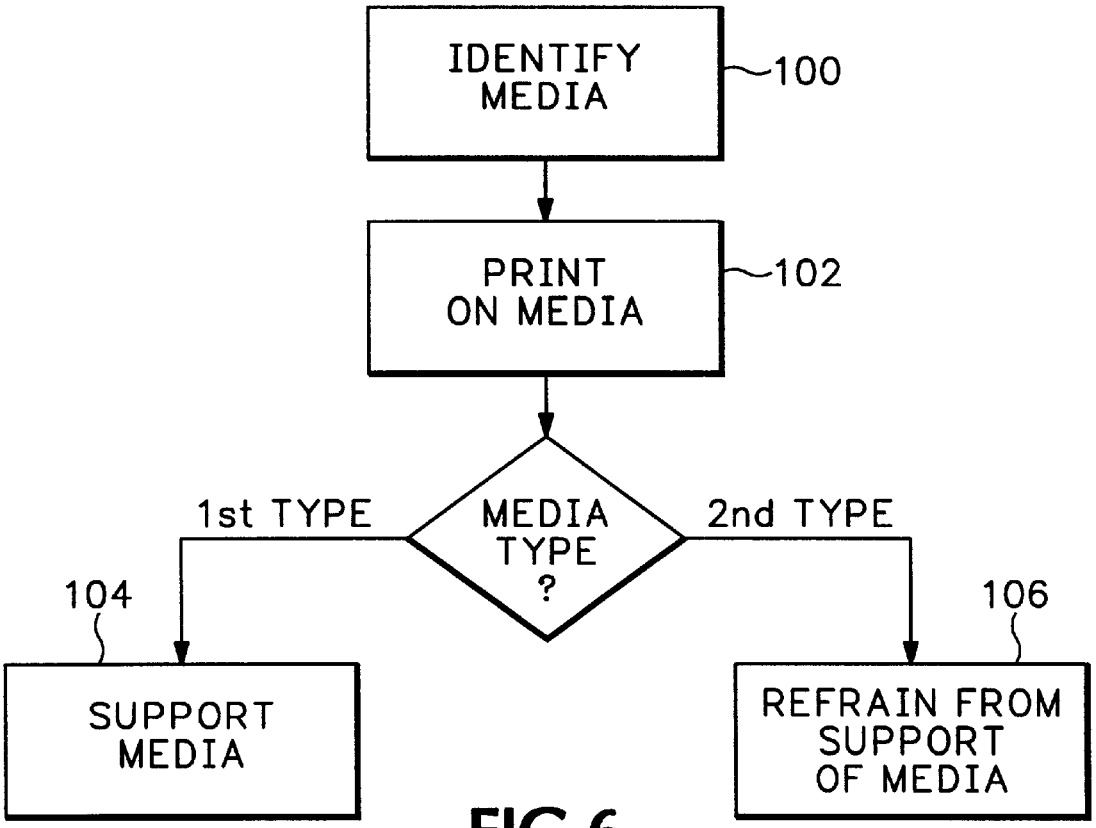
FIG. 6 is a flow chart demonstrating a media handling method in accordance with the present invention.

Based on the foregoing, it will be appreciated that the present system may be implemented by a media handling method set forth in FIG. 6. As indicated, such method includes steps of identifying a type of media passing through the media path at 100, printing on the media at 102, and selectively supporting the media upon expulsion from the output port as indicated at 104 and 106. As will be appreciated, media is supported upon expulsion from the output port where it is identified as being of a first media type as indicated at 104. Where the media is identified as being of a second media type, the printer refraining from support of the media upon expulsion from the output port as indicated at 106.

Media may be identified, as described above, by determining whether the media has a width within a predetermined range (as determined by sensing media within a predetermined transverse region), media width within such predetermined range being indicative of media of a first media type. Media with a width outside of the predetermined range (as determined by failure to sense media within the predetermined transverse region) is indicative of media of a second media type.

Media width may be determined upon detecting receipt of media within the media path. A sensor thus is positioned at a selected transverse position within the media path such that it will sense passage of selected media, failure to sense known passage of media along the media path being indicative of media type. As indicated above, the sensor may take the form of an optical sensor configured to sense a change in luminance, luminance within a predetermined range being indicative of presence of media.

Alternatively, the identifying step may include scanning the media with an optical sensor to determine media width, and matching the determined media width to a known media width, such known media width being indicative of media type. The media also may be identified by the user, either via an associated computer, or via direct input to the printer, by sensor, or by simple presumption based on known facts.

In accordance with one embodiment of the invention, it is assumed that the media is of the second media type, and the printer does not support the printed media. However, the initial printed media sheet of the print job is identified upon passing through the media path, and a next-printed media sheet of the print job is assumed to be of the identified media type. The next-printed sheet thus is supported upon expulsion from the output port where the initial media sheet was identified as being of a first media type, and is not supported where the initial media sheet was identified as being of the second media type. In order to provide the ink on the last printed sheet of a preceding print job adequate time to dry, printing of the initial sheet of a present print job does not begin until after a predetermined amount of time has elapsed since printing the last sheet of the preceding print job.

INDUSTRIAL APPLICABILITY

As previously indicated, the present invention is intended for use in an ink-jet printer, but may be used in virtually any printer wherein different types of media are used. Similarly, the invented system may be used to detect various different types of media, it being possible to adapt the system by changing the detector's transverse position or by employing multiple sensors.

While the present invention has been shown and described with reference to the foregoing operational principles and embodiments, it will be apparent to those skilled in the art that other changes in form and detail may be made without departing from the spirit and scope of the invention as defined in the appended claims.

We claim:

1. A media handling system for use in a printer having a printhead and a media path along which media travels past the printhead, the system comprising:

a media width sensor configured to sense passage of media through the media path, the media width sensor being configured to sense presence of media at a transverse position within the media path to accommodate identification of media type, the media width sensor being positioned in a first transverse position along the media path such that media in the media path which exceeds a predetermined width is sensed by the sensor to identify the media as being of a first type; and a media support positioned along the media path downstream from the sensor, the media support being configured to support printed media of the first type upon identification of the media by the media width sensor as being of the first type, and being configured to refrain from support of the printed media upon identification of the media by the media width sensor as being of a second type.

2. The system of claim 1, which further comprises a media detector configured to detect all media received within the media path.

3. The system of claim 1, wherein detection of media by the media detector without corresponding sensing of the media by the media sensor identifies the media as being of the second type.

4. The system of claim 1, wherein the sensor is an optical sensor.

5. The system of claim 4, wherein the optical sensor is configured to travel transversely within the media path.

6. The system of claim 5, wherein the optical sensor is configured to sense presence of media at plural transverse positions of the media path.

7. The system of claim 6, wherein media is positioned within the media path such that a transition from sensing media at a first selected transverse position to not sensing media at a second selected transverse position determines media width.

8. The system of claim 7, which further comprises a processor with a memory including a look-up table which identifies widths of a plurality of media types, the processor being configured to identify type of media using the determined media width.

9. A media handling method for use in a printer having a printhead and a media path along which media travels past the printhead, the method comprising steps of:

identifying a type of media passing through the media path;

printing on the media; and where identified media is of a first media type, supporting media upon expelling the media; and where the media is of a second media type, refraining from support of the media upon expelling the media.

10. The method of claim 9, wherein the identifying step includes determining whether the media has a width within a predetermined range, media width within such predetermined range being indicative of media of a first media type.

11. The method of claim 10, wherein media width outside of the predetermined range is indicative of media of the second media type.

12. The method of claim 9, wherein the second media type is an envelope.

13. The method of claim 9, wherein the identifying step includes:

detecting receipt of media within the media path;

positioning a sensor at a selected transverse position within the media path; and sensing passage of media past the sensor, failure to sense known passage of media along the media path being indicative of media type.

14. The method of claim 13, wherein the sensor is an optical sensor configured to quantify in luminance, luminance within a predetermined range being indicative of presence of media.

15. The method of claim 9, wherein the identifying step includes:

scanning the media with an optical sensor to determine media width; and matching the determined media width to a known media width, such known media width being indicative of media type.

16. The method of claim 9, wherein media of the first type is supported by retractable wings upon leaving a print zone of the printer.

17. The method of claim 9, wherein media of the second type is permitted to fall freely upon leaving a print zone of the printer.

18. The method of claim 9, which further comprises:

prior to identifying the type of media passing through the media path, refraining from support of the media upon printing.

19. A media handling method for use in a printer having a printhead and a media path along which plural pieces of media of a multi-piece print job travel, the media path including a print zone where printing occurs and an output port through which media exits the printer, the method comprising steps of:

passing an initial piece of media along the media path;

printing on the initial piece of media;

refraining from support of the initial piece of media as it exits the output port;

positioning a sensor at a selected transverse position within the media path;

sensing passage of the initial piece of media via the sensor to identify media type;

passing a subsequent piece of media along the media path;

printing on the subsequent piece of media;

assuming that the subsequent piece of media is of a media type corresponding to the identified media type of the initial piece of media;

where the identified initial piece of media is of a first type, supporting the subsequent piece of media as it exits the output port; and where the identified initial piece of media is of a second media type, refraining from support of the subsequent piece of media as it exits the output port.

20. The method of claim 19, wherein the sensing step includes:

detecting receipt of the initial piece of media within the media path;

positioning a sensor at a selected transverse position within the media path; and sensing passage of the initial piece of media past the sensor, failure to sense known passage of media along the media path being indicative of media of a second media type.

21. The method of claim 20, wherein the sensor is an optical sensor configured to sense a change in luminance, luminance within a predetermined range being indicative of presence of media.

22. The method of claim 19, wherein the sensing step includes:

scanning the initial piece of media with an optical sensor to determine media width; and matching the determined media width to a known media width, such known media width being indicative of media type.

23. The method of claim 19, wherein printing on the initial piece of media occurs after a predetermined elapsed time since completing a next-previous print operation.

* * * * *